US006849846B2

(12) United States Patent
Bertsch

(10) Patent No.: US 6,849,846 B2
(45) Date of Patent: Feb. 1, 2005

(54) PRECISION MULTIPLE ELECTRODE ION MIRROR

(75) Inventor: James L. Bertsch, Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 168 days.

(21) Appl. No.: 10/227,018

(22) Filed: Aug. 23, 2002

(65) Prior Publication Data

US 2004/0036029 A1 Feb. 26, 2004

(51) Int. Cl.[7] ..... H01J 49/40; H01J 9/18

(52) U.S. Cl. ..... 250/287; 313/360.1; 445/33; 445/35; 29/825

(58) Field of Search ..... 250/287, 396 R; 313/359.1, 360.1, 361.1; 445/35, 33; 29/825

(56) References Cited

U.S. PATENT DOCUMENTS 5,235,182 A * 8/1993 Avida et al. ..... 250/287
5,280,175 A * 1/1994 Karl ..... 250/287
5,661,300 A * 8/1997 Hansen et al. ..... 250/287
5,834,771 A * 11/1998 Yoon et al. ..... 250/287
5,955,730 A * 9/1999 Kerley et al. ..... 250/287
5,994,695 A * 11/1999 Young ..... 250/287
5,998,215 A * 12/1999 Prather et al. ..... 250/287
6,049,077 A * 4/2000 Franzen ..... 250/287
6,107,625 A * 8/2000 Park ..... 250/287
6,717,135 B2 * 4/2004 Hansen ..... 250/287

* cited by examiner

*Primary Examiner*—Jack I. Berman

(57) ABSTRACT

A method of constructing an ion mirror having an axial axis which includes arranging electrode plate elements in parallel alignment along the axial axis and attaching a rigid structure to all of the electrode plate elements with adhesive, thereby fixing the electrode plate elements in their respective axial positions and parallel alignment. In an embodiment of the method, the electrode plate elements are arranged in parallel alignment by turning the electrode plate elements from a single workpiece. In an alternative embodiment, the electron plate elements are arranged in parallel alignment by stacking the electrode plate elements using precisely dimensioned spacers, and the spacers are then removed after attachment of the rigid structure.

32 Claims, 6 Drawing Sheets

PRECISION MULTIPLE ELECTRODE ION MIRROR

FIELD OF THE INVENTION

The present invention relates to mass spectrometer systems, and more particularly, but without limitation, relates to a precision turned multiple electrode ion mirror used to manipulate ion trajectories in mass spectrometer systems.

BACKGROUND INFORMATION

Ion mirrors, or reflectrons, are components used in mass spectrometer systems to reverse or redirect the trajectory of ions as they travel toward a detector within a mass analyzer. In particular, ion mirrors are often used in Time-of-Flight (TOF) mass spectrometers where they are placed at the end of a drift region. FIG. 1 depicts a conventional ion mirror 5 with top portions cut away for illustrative purposes. A series of electrically conductive electrode plate elements 10, which can vary in number, are arranged spaced apart in the axial direction by insulating spacer elements 15. As shown, the electrode plate elements 10 are configured as rectangular rings enclosing a central ion conduit region 20 through which ions travel axially. The electrode plate elements 10 can also be configured as circular annular rings. In addition to electrode plate elements 10, one or more grid elements 25 are arranged perpendicular to the axis of the ion mirror 5. Voltages applied to the electrode elements and grid elements generate a retarding electric field within the ion conduit region 20. In gridded mirrors, electrode plate elements 10 are typically spaced evenly and the applied voltages are derived from resistor stacks of equal value, generating a constant field. The grid elements 25, coupled to separate voltage sources, function as borders between regions having different electric fields. Grid elements 25 placed at the ends of the ion conduit region 20 terminate the fields so that the fields within the ion conduit region 20 exert no forces outside of the ion mirror 5. Gridless ion mirrors are also used, in which electrode plate elements may or may not be equally spaced, but are usually tuned with various voltages not simply derived from linear resistor networks.

In either case, in typical orthogonally pulsed instruments, the ions often enter the mirror with a natural angle with respect to the longitudinal axis of the mirror based on the ratio of the pulsing energy to the ion source energy, and the mirror is placed parallel to the pulser. As shown in FIG. 1, the ions then exit the mirror with approximately the same angle to the longitudinal axis as if reflected from the entrance of the mirror.

Ion mirrors can be used advantageously to improve the mass resolution of TOF mass spectrometers. Typically, the mass resolution of TOFs is limited by such factors as uncertainties in: the time when the ions were pulsed (time distribution); their location in the accelerating field when pulsed (spatial distribution); and variation in initial kinetic energies prior to acceleration (energy distribution). The spatial distribution of ions in the pulsing region is associated with an energy distribution that leads directly to a corresponding time distribution in the time the ions reach the detector. If properly designed, a reflectron ion mirror can compress the time distribution caused by the initial pulser space distribution. This is possible because with larger kinetic energies, ions penetrate the retarding field more deeply before being turned around. These "faster" ions catch up with the slower ions at the detector. Effectively, the initial spatial distribution can be reduced by an order of magnitude at the crucial time when the ions hit the detector. Thus the initial spatial distribution need not compromise a desired high temporal resolution.

One of the prerequisites for a high degree of improvement in temporal resolution is that the equipotential lines of the retarding electric field within the ion conduit region must be parallel across the width of the ion packet as it travels the through the ion mirror. Although instruments typically have only a few ions in every pulse, it is nevertheless useful to conceptualize an ion packet that is the summation of many consecutive pulses. FIG. 2 schematically illustrates an axial section of an ion mirror in which the equipotential lines 40*a* are parallel. It is found that generating and maintaining parallel equipotential lines places high mechanical tolerances on both the electrode elements and the insulating spacers. In particular, systematic errors in the sizes of the electrode plate elements can cause an ion mirror assembly to expand or contract along its axis. If "n" plate elements are used, then non-random errors in plate size must be 1/nth of the amount of drift that can be tolerated in the assembly as a whole. Furthermore, cumulative errors can build up if the insulating spacers are not precisely dimensioned. FIG. 3 schematically illustrates the effect that such systematic errors and other commonly occurring inaccuracies, such as misalignment, can have on the contour of equipotential lines within the ion conduit region of an ion mirror. As shown, equipotential lines 40*b* are not parallel. Ion packets traveling axially will be subject to different electric fields depending upon their radial location within the conduit bore. Accordingly, the spatial distribution and time distribution of the ion packet will tend to broaden, canceling the spatial and temporal focusing effects of the electric fields applied in the ion mirror. To avoid the deleterious consequences of inaccuracies in plate and spacer dimensions, pre-measuring and sorting can be performed to compensate for the systematic errors and drifts in plate and spacer size. However, these operations involve significant part and labor costs.

SUMMARY OF THE INVENTION

It is therefore an object of the present invention to provide an ion mirror having improved parallelism between mirror elements and also to provide a method of constructing such an ion mirror with improved parallelism.

The present invention provides a method of constructing an ion mirror having an axial axis which includes arranging electrode plate elements in parallel alignment along the axial axis, and attaching a rigid structure to all of the electrode plate elements with adhesive thereby fixing the electrode plate elements in their respective axial positions and parallel alignment.

In an embodiment of the method of constructing an ion mirror according to the present invention, the electrode plate elements are arranged in parallel alignment by turning the electrode plate elements from a single workpiece. In one implementation, the electrode plate elements are physically separated after attachment of the rigid structure.

In another embodiment, the electron plate elements are arranged in parallel alignment by stacking the electrode plate elements using precisely dimensioned spacers, the spacers are then removed after attachment of the rigid structure.

In another embodiment, the electrode plate elements are spaced so as to establish a linear potential gradient along the axial axis when voltages are applied to the electrode plate elements.

In yet another embodiment, the rigid structure to which the electrode plate elements are attached includes an axial rod having a low electrical conductivity.

In alternative implementations, the electrode plate elements may be provided with grooves adapted to receive the axial rod, or the electrode plate elements may be provided with a mounting surface edge adapted to form a mounting surface for the axial rod. The ends of the axial rod may be coupled to a voltage source for supplying potentials to the electrode plate elements. Furthermore, a voltage divider network may be attached to the electrode plate elements to establish a linear potential gradient.

The present invention also provides a method of constructing an ion optics apparatus including elements aligned in parallel which includes fixing the elements in position in parallel alignment with precise spacings between the elements and attaching a rigid structure to each of the elements with adhesive, thereby permanently fixing the elements in their respective positions and alignment. The elements of the ion optics apparatus may include at least one of an electrode, a cylinder lens, an aperture lens and a deflection plate.

In an embodiment of the method of constructing an ion optics apparatus according to the present invention, the elements are fixed in position by turning the elements from a single workpiece.

In another embodiment, the elements are fixed in position by conjoining the elements along a single workpiece. The conjoined elements may then be detached along the workpiece after attachment to the rigid structure.

In another embodiment, the elements are fixed in position by inserting precisely dimensioned removable spacers between at least two of said elements.

According to this embodiment, the spacers can then be removed after attachment of the rigid structure.

At least two of the elements may be provided with grooves or mounting surface edges to facilitate attachment to the rigid structure.

The present invention also provides an ion mirror having an axial axis that includes a plurality of electrode plate elements and a rigid structure attached to each of the plurality of electrode plate elements with adhesive, wherein the rigid structure fixes the electrode plate elements in relative positions along the axial axis and in a parallel alignment.

In an embodiment of the ion mirror according to the present invention, the rigid structure comprises a resistive rod. According to an implementation, the resistive rod may be made from a material having a low coefficient of thermal expansion. A voltage source may be coupled to the resistive rod, and a voltage divider network coupled to the plurality of electrode plate elements to establish a linear potential gradient along the axis of the ion mirror.

DETAILED DESCRIPTION

In accordance with a first embodiment of the present invention, a significant improvement in both the flatness and parallelism of equipotential lines in the ion conduit region of ion mirrors is achieved by precision-turning electrode plate elements from a workpiece and then fixing their relative positions by attaching insulating spacer rods to the electrode plate elements with adhesive. The term "turning," as used herein, denotes removal of material from the outer diameter of a rotating workpiece on an automatic or manual machine tool. By turning a single workpiece, all of the electrode surfaces are machined in their final assembled positions, in parallel alignment with respect to each other. According to a second embodiment, individual electrode plate elements are made by separate turning operations and arranged with precise removable spacers which maintain the electrode surfaces in parallel alignment. The plate elements are then similarly fixed in relative position by attaching insulating spacer rods to the arrangement with adhesive.

Figure 1:
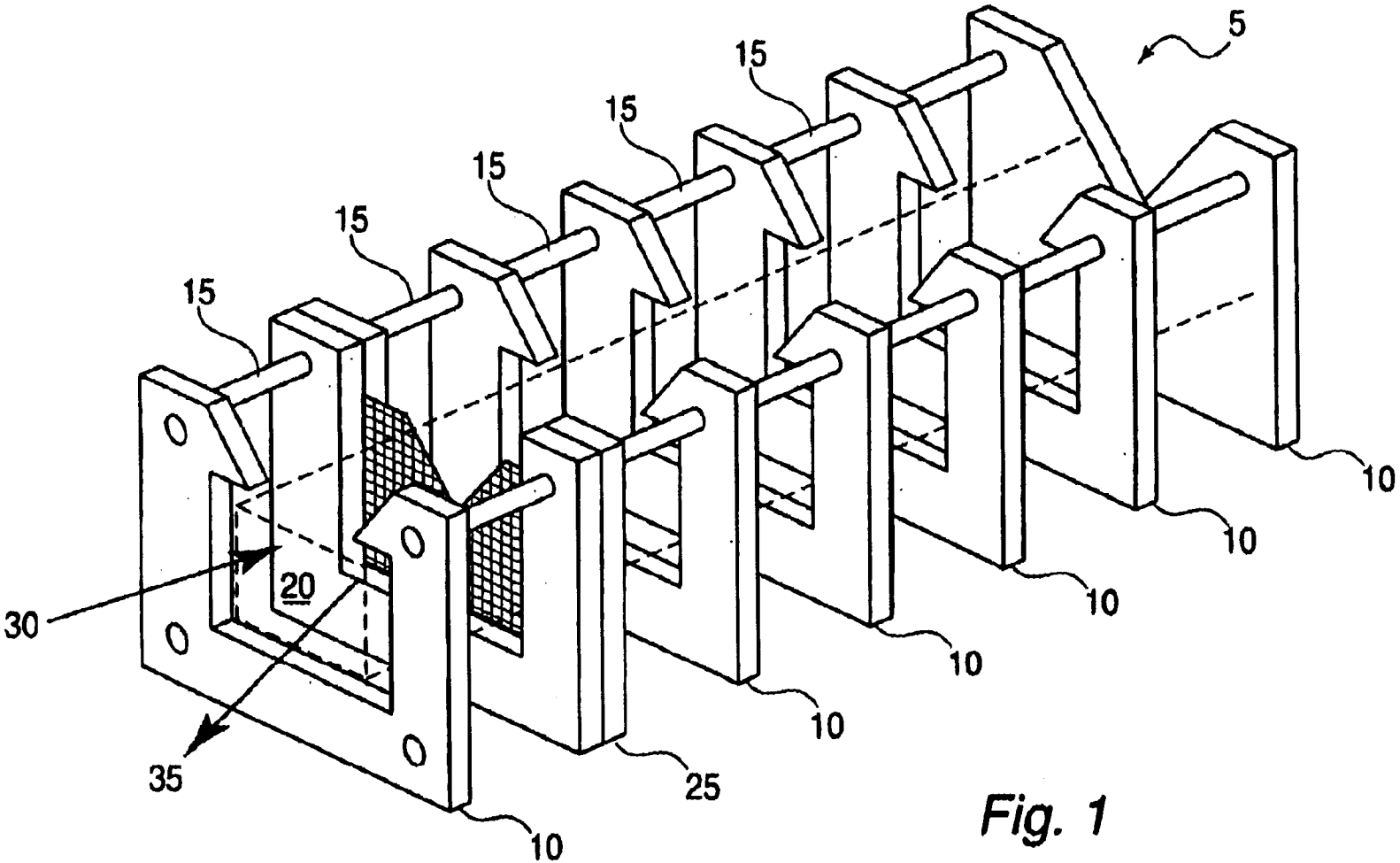
Fig. 1 PRIOR ART
FIG. 1 shows a conventional ion mirror assembly.
Figure 2:
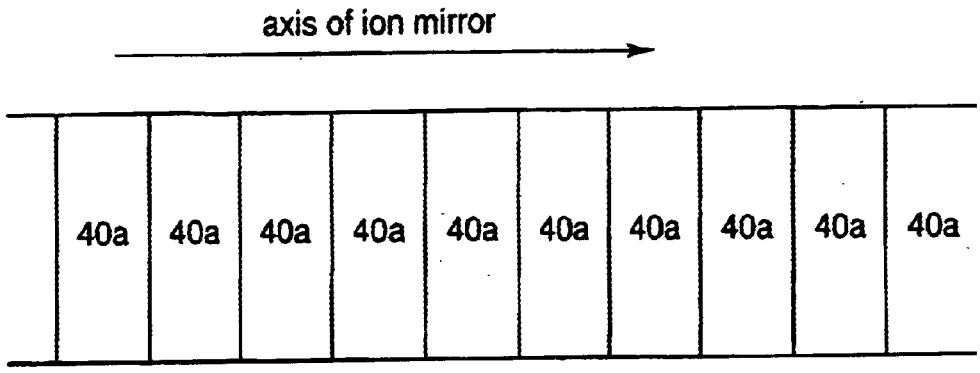
FIG. 2 illustrates parallel equipotential lines within an ion conduit region of an ion mirror associated with increased mass resolution.
Figure 3:
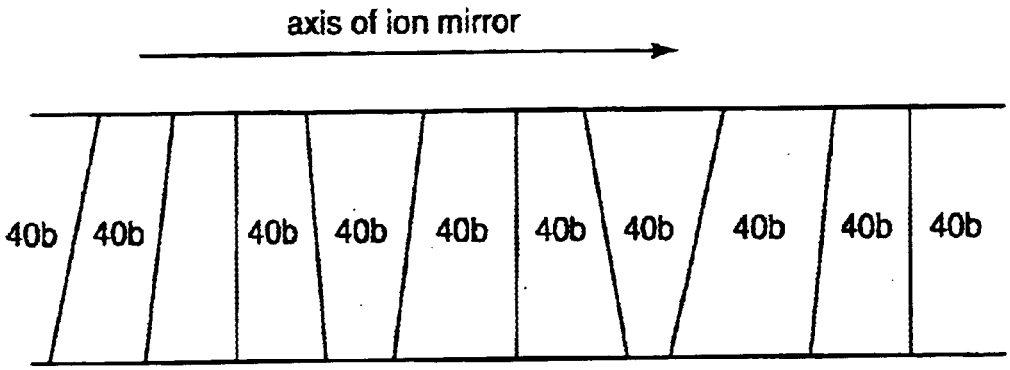
FIG. 3 illustrates non-parallel equipotentional lines within an ion conduit region of an ion mirror associated with reduced mass resolution.
Figure 4:
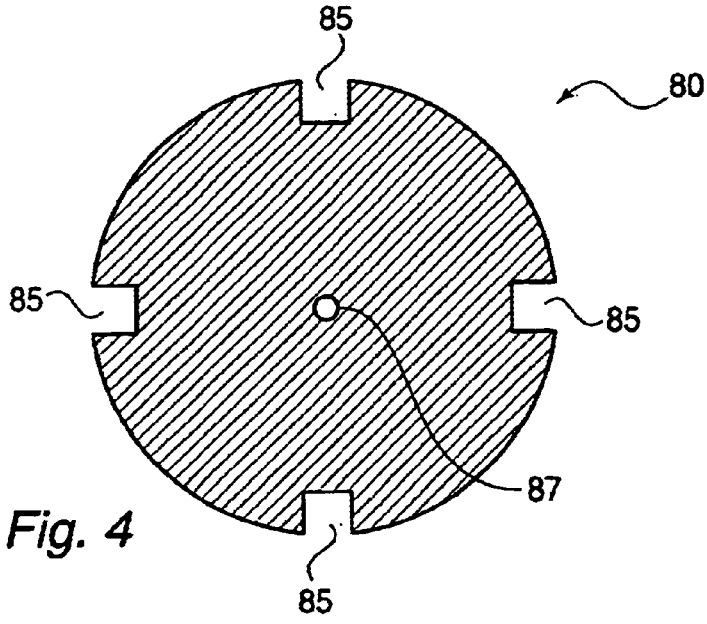
FIG. 4 shows a cross section of an ion mirror workpiece indicating axial grooves and a central bore hole arranged according to an embodiment of the present invention.
Figure 6:
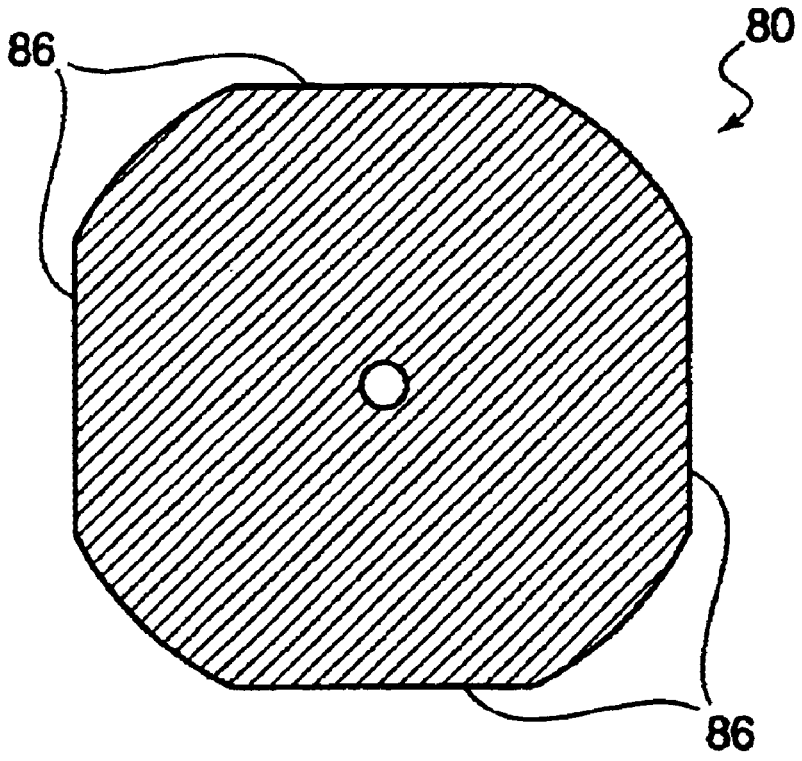
FIG. 6 shows a cross section of an ion mirror workpiece indicating mounting surface edges and central bore holes arranged according to an embodiment of the present invention.

Construction of an ion mirror according to a first embodiment of the present invention begins with providing axial grooves or mounting surface edges into the outer diameter of a solid workpiece which may be made from metals suitable for the vacuum and thermal conditions within a time-of-flight mass spectrometer. The axial grooves or mounting surface edges are adapated to provide a groove or surface for receiving an axial rod or other structure and can be provided by various techniques including machining, cutting, boring, casting, stamping, and the like. FIG. 4 shows a cross-section of a solid workpiece 80 having four equally spaced axial grooves 85 that run along the entire axial length of the workpiece. Although rectangularly shaped grooves are shown, other shapes amenable for accepting insulating rods, such as semi-circular grooves can equally be employed, and a greater number of grooves such as six or eight may also be used. Alternatively, instead of axial grooves, the outer surface of the workpiece may have flattened mounting surface edges 86, shown in FIG. 6. Mounting surface edges 86 may be particularly suitable for conveniently affixing flat-sided insulators to the mirror elements. A central axial hole 87, if not already present in the workpiece, is then drilled through the center of the workpiece with a drill or a boring bar. The dimensions of the hole are made large enough for a wire to be extended through the hole. Making the central hole 87 larger can reduce the weight of the workpiece during the turning operation, decrease the length of cut when the center is removed, and if already present in the workpiece, can reduce its cost. Before turning the radial grooves, any machining or cross-drilling operations required on the ends of the workpiece are performed. This reduces the chance that later drilling, boring and tapping operations that may be used in the context of the present invention will degrade the inherent precision achieved during turning.

The workpiece is then fixed on a machine tool and turned to define outer surfaces of the plate electrodes. FIG. 5A depicts an axial view of an embodiment of an ion mirror 100 according to the present invention. As shown, electrode plates, such as, for example, 102*a*, 102*b*, are separated from each other by turned sections (gaps) such as, for example, 104*a*, 104*b*. While the ion mirror 100 depicted in FIG. 5A includes nine electrode plate sections, the number of plate elements can be greater or fewer depending on the desired overall dimensions of the ion mirror and the desired thickness of the individual plates. In the embodiment shown, the ion mirror 100 is approximately 100 millimeters in length and the width of each of the plate elements 102*a*, 102*b*, and each of the gaps 104*a*, 104*b* is approximately 5 millimeters. It is again noted that these dimensions are exemplary and that in general the gaps 104*a*, 104*b* are set large enough so that surface conduction across the insulating spacers is kept under a threshold level when insulating spacer rods connect the plate elements 102*a*, 102*b* to each other. The gaps 104*a*, 104*b* are approximately twice as deep as they are wide. Narrow radial grooves 106*a*, 106*b* turned into the bottom of each gap section 104*a*, 104*b* make the gap between the electrode plates 102*a*, 102*b* small enough that ions are sufficiently shielded from the insulating spacer surfaces. The narrow grooves 106*a*, 106*b* are turned with a narrow cutter having a diameter that may be as small as one millimeter. An axial cross section of the ion mirror workpiece 100 shown in FIG. 5B more clearly illustrates electrode plate 102*a*, turned gap 104*a* and narrow radial groove 106*a*. The larger cutter is used first to decrease the unsupported length of the smaller cutter. Thus, in this example, only the last 5 mm of the small cutter need be the thin 1 mm width. The remainder of the parting tool can be almost as wide as the wider gaps. This reduces tool vibrations that can produce an uneven surface and thereby helps to produce a more uniform groove. Additionally, it is beneficial for the narrow cutter to cut deeper than the level of any axial grooves so that the turning operation is uninterrupted as the workpiece rotates a full turn, which prevents tool deflection and chatter during turning.

Perturbations of the interior field caused by the finite width of the electrode plates 102*a*, 102*b* can be reduced by setting the thickness of the gridded end electrode plates 107, 108 to half the thickness of the non-gridded plates. A turned ion mirror according to the present invention can also be implemented without grid elements. According to this implementation, the electrode elements can be turned with non-uniform spacings. In addition, the inside bore could be tapered if desired to tailor the field to maintain the flatness of the equipotential lines across the ion beam.

Figure 5C:
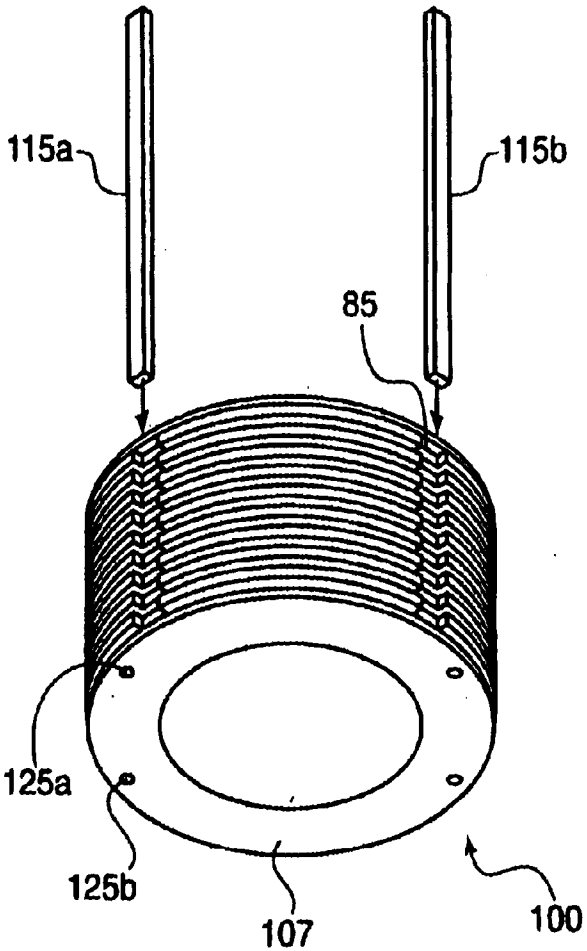
FIG. 5C shows a perspective view of the ion mirror according to an embodiment of the present invention including insulating rods shown in an unattached position.
Figure 5B:
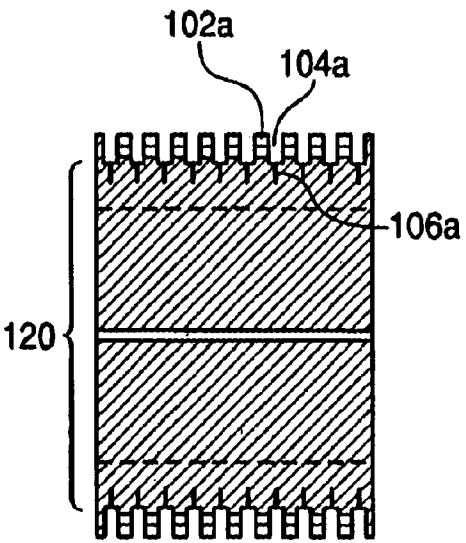
FIG. 5B shows a central cross-section of the view shown in FIG. 5A.
Figure 5A:
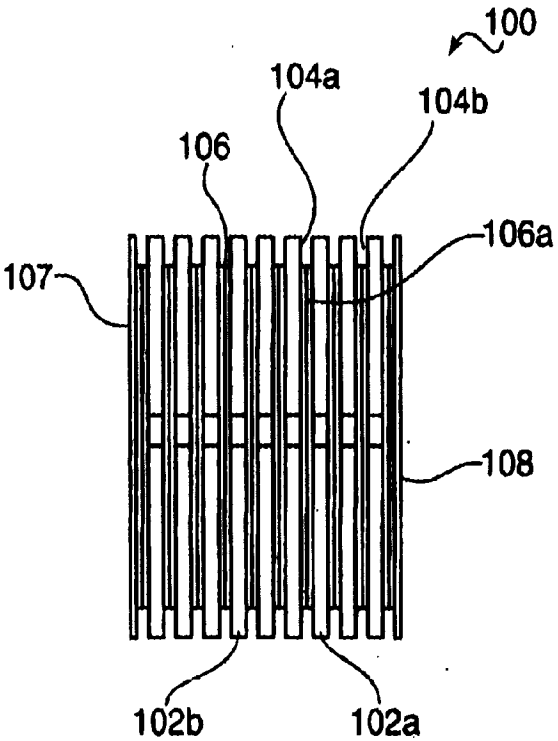
FIG. 5A shows a front view perpendicular to the longitudinal axis of an embodiment of an ion mirror according to the present invention.

According to an embodiment of the present invention, after the turning of the gaps and radial grooves into the workpiece, full-length insulating rods such as 115*a* and 115*b*, as shown in FIG. 5C, are inserted into the axial grooves 85 or mounted onto the axial mounting surface edges 86. The insulating rods may be rectangular prisms or cylinders and can be made from a material having a low thermal expansion coefficient. Suitable materials for the rods 115*a*, 115*b* may include glass, alumina or silicon nitride. A practical consideration for suitability of the rod material is that it be insulating, with resistivity greater than about 1000 ohm-cm, for example. Although only two rods are shown, the number of rods used can match the number of axial grooves or mounting surface edges arranged on the circumference of the workpiece, which as noted above, can range in number. Once inserted or mounted into place, the insulating rods 115*a*, 115*b* are affixed to the workpiece with an adhesive such as an epoxy. In embodiments in which there is a large difference in the thermal expansion coefficient of the workpiece and the insulating rods, an adhesive that cures at a low temperature, such as Torr Seal®, can be used.

After the insulating rods are affixed to the ion mirror workpiece and the electrode plates are fixed in their relative position and alignment, the inner core of the workpiece is removed by wire electrical discharge machining (wire EDM), creating the ion conduit region. In wire EDM, an electrically conducting tungsten wire is threaded though the axial hole bored through the workpiece and material is removed as the wire is pushed out radially from the hole. Additional core removal techniques that can be employed in this context include waterjet machinining and abrasive waterjet machining, which, like wire EDM, exert low force on the surrounding ion mirror structure. Referring again to FIG. 5B, the diameter of the bore 120 is extended radially past the deepest extend of the grooves, such as 106*a*, so that the electrode plates become electrically separated, and physically coupled only through the insulating rods that run between them. If the workpiece is made from a material subject to surface oxidation, such as aluminum, the surfaces of the electrode plates may be electroplated with a conductive material such as nickel, gold or chromium. Care may need to be taken to avoid plating any portions of the insulating rods.

Alternatively, according to a second embodiment of constructing a precision turned ion mirror according to the present invention, a number of individual electrode plate elements are made by separate turning operations and detached from one or more workpieces. The electrode plate elements are arranged sequentially in a stack, with each of electrode plate elements separated from adjacent elements using reusable precision spacers which keep the individual electrode plate elements in parallel alignment in the stack arrangement. After being stacked, the individual electrode plate elements may be drilled, bored, and/or machined to remove their respective central portions. This can be performed by a single EDM operation. Boring the plate elements after aligning them in a stack improves the uniformity and alignment of the bored sections among the elements. With the precision spacers still in place, axially extending insulating rods that run along the entire axial length of the stack are then fixed to the electrode plate elements in axial grooves or mounting surface edges as described above. Since the electrode plate elements are fixed in relative position by the attached insulating rods, the precision spacers may be removed from the assembled ion mirror, to be used repeatedly in further ion mirror construction.

After assembly of the ion mirror according to either the first or second embodiments of the present invention, grids are attached to the end plates of the ion mirror and to any internal electrode plates where a sharp change in electrical gradient is desired. Typically, a mesh is stretched across each of such plates. Alternatively, wires are stretched across the surface of a plate so that they are aligned parallel to each other and then are pressed and attached to the plate, for example, with an adhesive. However, if the plates are not precisely flat, the stretched wire grid will not be completely parallel. Advantageously, through precision turning, flatness of the plates can be assured for establishing a parallel surface for grid wiring or for mesh attachment.

To conveniently provide for connection to a voltage source, small holes such as 125*a*, 125*b* (shown in FIG. 5C) are drilled into the end plates. In the embodiment shown, the insulating rods, having a constant bulk resistance per unit length, can provide a linear potential gradient when their respective ends are connected across a potential difference. Each electrode plate is then maintained at a different voltage, and a constant electric field is generated within the ion conduit region. In this case, care is taken to maintain the resistance level of the insulating rods so that the level of electrical conductivity along the rods does not compromise their function as insulators between the electrode plates of the ion mirror. Where it is not convenient or feasible to use the bulk resistance of the insulating rods themselves to establish a potential gradient, a set of resistors can be attached to regular intervals to insulating rods as depicted in the exemplary embodiment shown in FIGS. 7 and 8.

Figure 7:
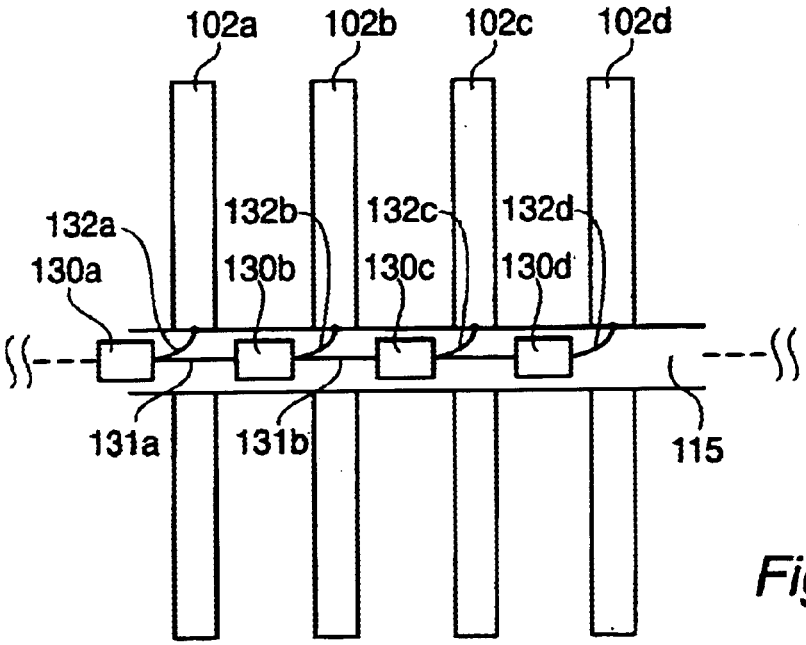
FIG. 7 shows an axial section of an ion mirror having a voltage divider network attached to the insulating rods according to a first embodiment of the present invention.

As shown in FIG. 7, a series of resistor elements 130*a*, 130*b*, 130*c*, 130*d* of a section of the ion mirror are fixed with a non-conductive adhesive on the insulating rod 115. The first and last resistors on the mirror (not shown) are coupled to a direct current (DC) voltage source and sink respectively (not shown) to provide a potential gradient across the resistor elements. The resistor elements 130*a*, 130*b*, 130*c*, 130*d*, which in an example embodiment may have equal resistance values, are spaced on the rod 115 so that each resistor is axially arranged near one of the electrode plate elements 102*a*, 102*b*, 102*c*, 102*d* of the section of the ion mirror. According to one implementation, the resistors are placed on a flat face 116 of the insulating rod directed away from the electrode plate elements (shown in FIG. 8). Conductive traces 131*a*, 131*b*, 131*c*, 131*d* made of a partially conductive film of sub-millimeter thickness can be baked onto the rod 115 between the respective resistor elements 130*a*, 130*b*, 130*c*, 130*d*, with care being taken to avoid baking the conductive traces over the resistor elements. To couple the voltage divider network to the electrode plate elements, small wire sections 132*a*, 132*b*, 132*c*, 132*d* are attached between portions of the conductive film traces 131*a*, 131*b*, 131*c*, 131*d* near to the lower-voltage ends of the resistor elements (so as to avoid a voltage drop across the conductive film) and the electrode plate elements 102*a*, 102*b*, 102*c*, 102*d*.

Figure 8:
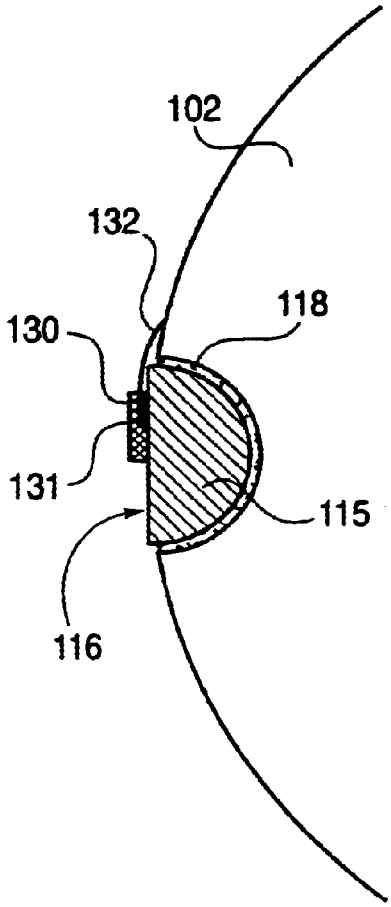
FIG. 8 is an enlarged view showing a coupling arrangement of an insulating rod to an electrode plate element according to an embodiment of the present invention.

FIG. 8 shows an enlarged cross-sectional view showing a single resistor element 130 placed against the flat face 116 of the insulating rod 115. As shown, wire section 132 is arranged to loop over the insulating rod 115 and the non-conductive adhesive 118 that fixes the rod to the electrode plate element 102 so as to couple the conductive trace 131 directly to the electrode plate element.

Figure 9:
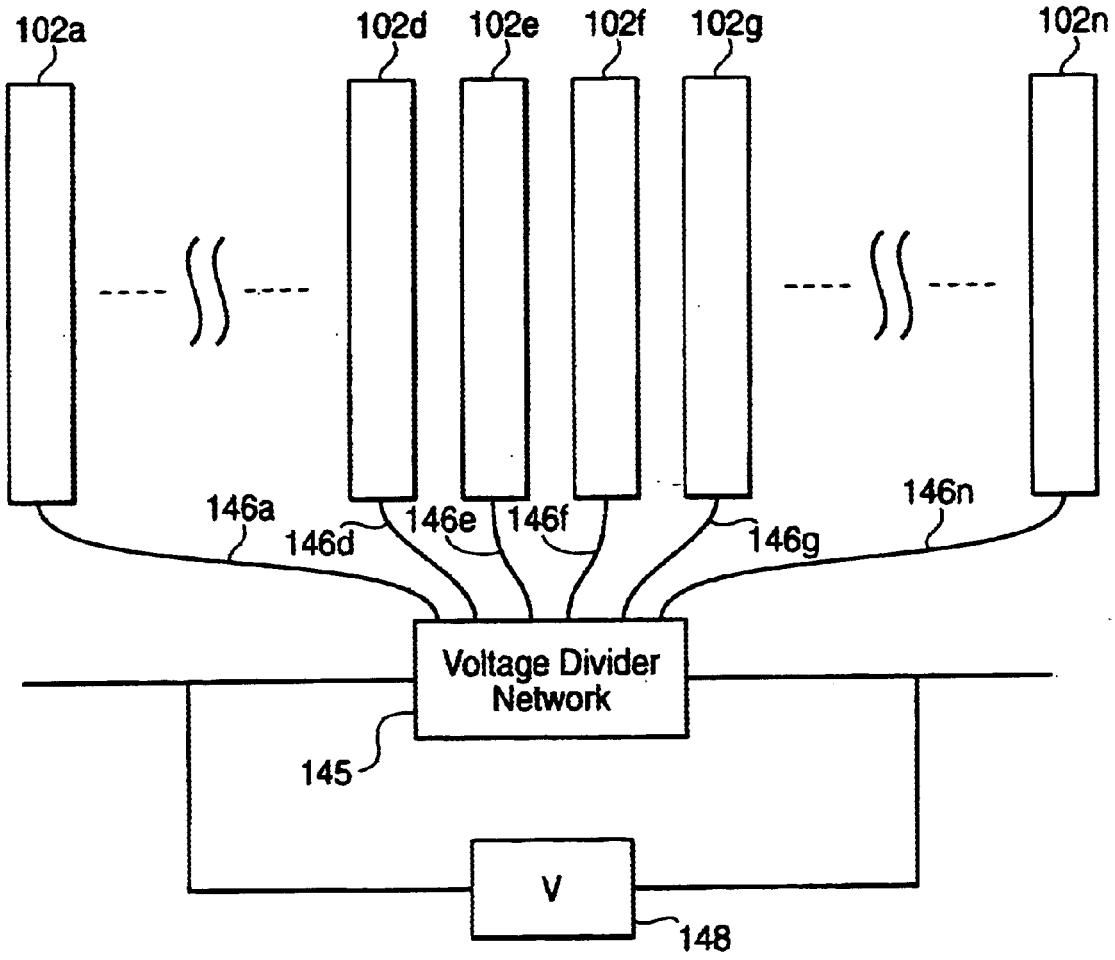
FIG. 9 shows a cross section of an ion mirror wired to a separate resistor divider chain.

In another example embodiment, as in FIG. 9, the resistors (shown collectively as a block 145) are positioned on a separate insulator to form a voltage divider network powered by voltage source 148 and are attached to the electrode plate elements 102*a*, 102*b* . . . 102*n* with discrete wires 146*a*, 146*b*, 146*c*, 146*d*.

The above-described ion mirror and the methods for its construction present several advantages. Fixing the relative position of the precision-turned electrode elements by attaching insulator rods with adhesive is an expedient and cost-effective method of ensuring parallelism in both gridded and non-gridded electrode plates over the entire structure of the ion mirror.

In addition, the present invention provides for a significant reduction in the number of individual parts required for construction. For example, a conventional one stage mirror with 20 electrode plate elements, a back plate, a front grid, and four insulating spacers per gap would require over one hundred high precision parts. The first embodiment described provides superior performance using only one high precision gridded element, one precision flat back plate and four lower precision insulating rods. In a particular experimental design implementation, a two stage mirror that required approximately 80 high precision parts was redesigned using three high precision parts and eight medium precision parts according to the principles of the present invention. In the second embodiment, while a number of precision spacers are required during assembly, because the spacers are removed from the assembly and thereafter reused for subsequent assembly operations, successive operations do not require further precision spacers to be fabricated. The reduction in the number of precision parts required to be fabricated or used per assembly operation allows for a reduction in the time required for assembly and an elimination of the need to manually adjust the alignment of the ion mirror.

Use of insulating rods made from materials with low thermal expansion rates provides for significant reductions in thermal expansion of the ion mirror structure in the axial direction and consequently increases the mass resolution stability during temperature fluctuations. This contrasts with conventional designs which generally either have a high mechanical drift with temperature, or, to compensate for the drift, use electrode plates made from heavier and more expensive materials, such as invar, which are often difficult to machine to precision tolerances. In addition, connecting a voltage divider network directly to the surface of the insulating rods can be another time and cost-saving features as it eliminates the need to connect the voltage divider to each electrode plate with long wires.

In the foregoing description, the invention has been described with reference to a number of examples that are not to be considered limiting. Rather, it is to be understood and expected that variations in the principles of the method and system herein disclosed may be made by one skilled in the art and it is intended that such modifications, changes, and/or substitutions are to be included within the scope of the present invention as set forth in the appended claims.

Furthermore, the principles and techniques described herein have equal applicability to the design and construction of an ion pulser, or any ion optics device where a significant volume of parallel equipotential lines are desired or required. For example, the method of the present invention may be applied to the alignment of stacks of electrodes, cylinder lenses, aperture lenses and/or deflection plates used and the like used in ion optics apparatus by attaching these elements by adhesive to a rigid structure during assembly of such apparatus.

What is claimed is:

1. A method of constructing an ion mirror having an axial axis comprising:

arranging electrode plate elements in parallel alignment along the axial axis; and attaching a rigid structure to all of the electrode plate elements with adhesive thereby fixing the electrode plate elements in their respective axial positions and parallel alignment.

2. The method of claim 1, wherein arranging the electrode plate elements in parallel alignment comprises turning the electrode plate elements from a single workpiece.

3. The method of claim 2, further comprising: physically separating the electrode plate elements after attachment of the rigid structure.

4. The method of claim 1, wherein arranging electron plate elements in parallel alignment comprises stacking the electrode plate elements using precisely dimensioned spacers, and removing the spacers after attachment of the rigid structure.

5. The method of claim 1, further comprising: spacing the electrode plate elements such as to establish a linear potential gradient along the axial axis when voltages are applied to the electrode plate elements.

6. The method of claim 1, wherein the rigid structure includes an axial rod having a low electrical conductivity.

7. The method of claim 6, further comprising: providing a groove in the electrode plate elements adapted to receive the axial rod.

8. The method of claim 6, further comprising: providing a mounting surface edge on the electrode plate elements adapted to form a mounting surface for the axial rod.

9. The method of claim 6, further comprising: coupling a voltage source to the ends of the axial rod for supplying potentials to the electrode plate elements.

10. The method of claim 1, further comprising: attaching a voltage divider network to the electrode plate elements.

11. A method of constructing an ion optics apparatus including plate elements aligned in parallel without any spacers therebetween, comprising:

fixing the elements in position in parallel alignment with precise spacings between the elements;

attaching a rigid structure to each of the elements with adhesive to permanently fix the elements in their respective positions and alignment, wherein said elements are fixed in their respective positions without spacers in therebetween.

12. The method of claim 11, further comprising: turning the elements from a single workpiece.

13. The method of claim 11, wherein the elements include at least one of an electrode, a cylinder lens, an aperture lens and a deflection plate.

14. The method of claim 11, wherein fixing the elements in position comprises conjoining elements along a single workpiece, thereby creating conjoined elements.

15. The method of claim 14, further comprising: detaching the conjoined elements along the workpiece after attachment to the rigid structure.

16. The method of claim 11, wherein fixing the elements in position comprises inserting precisely dimensioned removable spacers between at least two of said elements.

17. The method of claim 16, further comprising: removing the spacers after attachment of the rigid structure.

18. The method of claim 11, further comprising: providing at least two of the elements with grooves for attaching with the rigid structure.

19. The method of claim 11, further comprising: providing at least two of the elements with mounting surface edges for attaching the rigid structure.

20. An ion mirror having an axial axis comprising:

a plurality of electrode plate elements; and a rigid structure attached to each of the plurality of electrode plate elements with adhesive, wherein the rigid structure fixes the electrode plate elements in relative positions along the axial axis and in a parallel alignment.

21. The ion mirror of claim 20, wherein the rigid structure comprises a resistive rod.

22. The ion mirror claim 21, wherein the resistive rod is made from a material having a low coefficient of thermal expansion.

23. The ion mirror of claim 21, further comprising: a voltage source coupled to the resistive rod.

24. The ion mirror claim 21, further comprising: a voltage divider network coupled to the plurality of electrode plate elements.

25. A method of constructing an ion optics apparatus including elements aligned in parallel comprising:

turning the elements from a single workpiece;

fixing the elements in position in parallel alignment with precise spacings between the elements; and attaching a rigid structure to each of the elements with adhesive thereby permanently fixing the elements in their respective positions and alignment.

26. The method of claim 25, further comprising: coupling a voltage source to said rigid structure for supplying potentials to the electrode elements.

27. The method of claim 25, further comprising attaching a voltage divider network to the elements.

28. The method of claim 25, wherein the elements include at least one of an electrode, a cylinder lens, an aperture lens and a deflection plate.

29. A method of constructing an ion optics apparatus including plate elements aligned in parallel comprising:

fixing at least two plate elements in position in parallel alignment by inserting precisely dimensioned removable spacers between said at least two plate elements;

attaching a rigid structure to each of the elements with adhesive thereby permanently fixing the elements in their respective positions and alignment; and removing the spacers after attachment of the rigid structure.

30. The method of claim 29, further comprising: coupling a voltage source to said rigid structure for supplying potentials to the electrode elements.

31. The method of claim 29, further comprising attaching a voltage divider network to the elements.

32. The method of claim 29, wherein the elements include at least one of an electrode, a cylinder lens, an aperture lens and a deflection plate.

* * * * *